US005626262A

United States Patent [19]

Fitten et al.

[11] Patent Number: 5,626,262

[45] Date of Patent: May 6, 1997

[54] DISPENSING CONTAINER WITH DRAINAGE PASSAGES

[75] Inventors: Timothy E. Fitten, Chaska, Minn.; Dieter F. Lay, Oconomowoc, Wis.; Thomas M. Bender, Reading, Pa.

[73] Assignee: Redmond Products, Inc., Chanhassen, Minn.

[21] Appl. No.: 477,534

[22] Filed: Jun. 7, 1995

[51] Int. Cl.[6] ..... B67D 5/06

[52] U.S. Cl. ..... 222/184; 222/185.1; 222/212; 222/481; 222/494

[58] Field of Search ..... 222/184, 185.1, 222/212, 481, 490, 494, 538

[56] References Cited

U.S. PATENT DOCUMENTS

| | | | |
|---|---|---|---|
| 4,728,006 | 3/1988 | Drobish | 222/494 X |
| 4,749,108 | 6/1988 | Dornsbusch et al. | 222/494 X |
| 4,969,581 | 11/1990 | Seifert et al. | 222/494 X |
| 5,033,655 | 7/1991 | Brown | 222/212 |
| 5,060,830 | 10/1991 | Krall | 222/185.1 X |
| 5,115,950 | 5/1992 | Rohr | 222/490 |
| 5,213,236 | 5/1993 | Brown | 222/185 |
| 5,337,877 | 8/1994 | Brown et al. | 222/105 |
| 5,339,995 | 8/1994 | Brown et al. | 222/185 |
| 5,409,144 | 4/1995 | Brown | 222/185 |

FOREIGN PATENT DOCUMENTS

| | | | |
|---|---|---|---|
| 0296103 | 12/1988 | European Pat. Off. | 222/212 |
| 9429187 | 12/1994 | WIPO | 222/494 |

OTHER PUBLICATIONS

Closure A as shown in photographs 1–2, (prior art).

Closure B as shown in photographs 1–3, (prior art).

Closure C as shown in photographs 1–3, (prior art.

*Primary Examiner*—Joseph Kaufman

*Attorney, Agent, or Firm*—Kinney & Lange, P.A.

[57] ABSTRACT

The present invention relates to a dispensing container having an inner cavity for storing content, such as bath products and shampoo, to be dispensed and an opening for dispensing content. The container is supported by a base having a face including a rim ridge about the periphery thereof to define an elevated support ridge and a recessed end surface. A drain slot extends through the rim ridge for allowing fluid trapped under the rim ridge to escape. The base of the container is formed of a base cap which is coupled to a bottle to form the container. The bottle includes a main container segment, a neck having a diameter sized smaller than the main container segment and a shoulder connecting the main container segment and neck. A wall extends from the face of the base cap to define an interior cavity for the base cap. The base cap is sized so that the neck and shoulder of the bottle fits into the interior cavity of the base cap and an exposed end of the wall of the base cap abuts the bottle and a base cavity is defined between the base cap and the bottle. A drainage hole is included through the face of the base cap to allow fluid to escape from the base cavity between the base cap and the bottle.

19 Claims, 6 Drawing Sheets

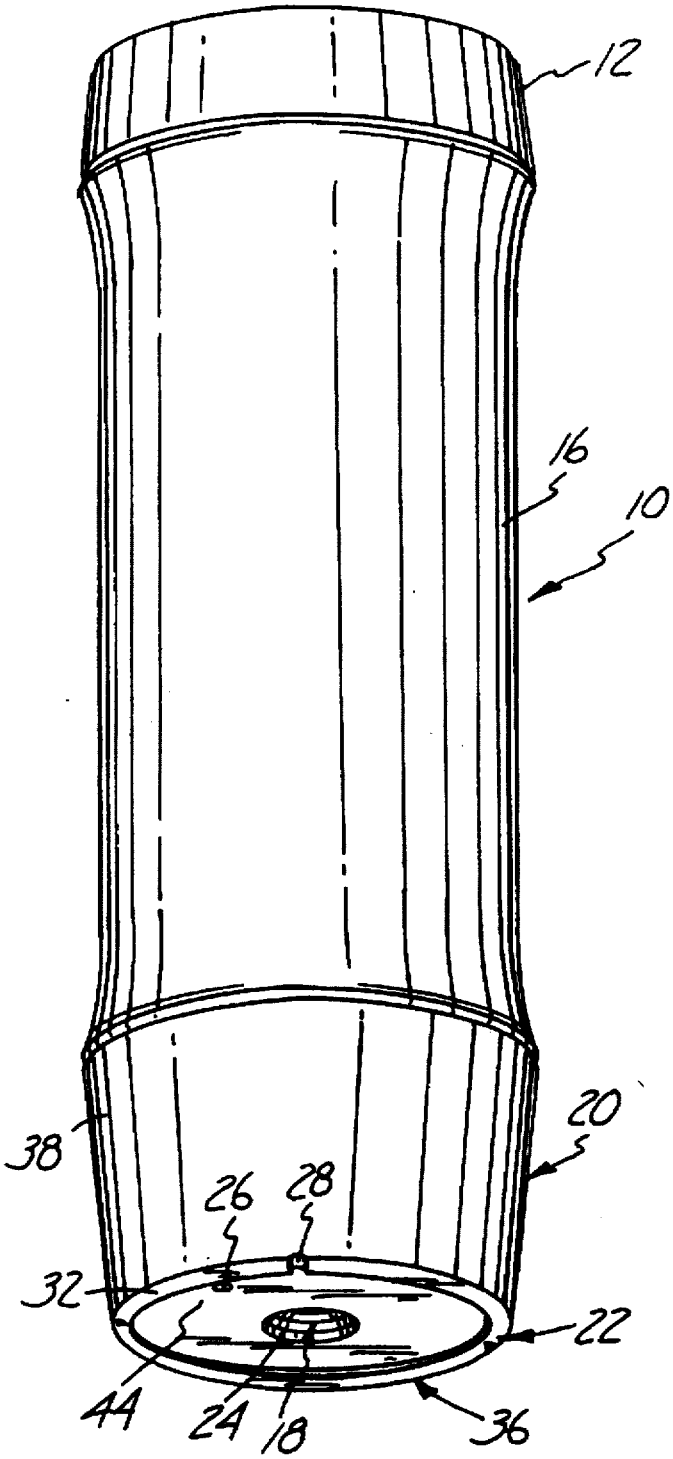
Fig. 1
Fig. 2
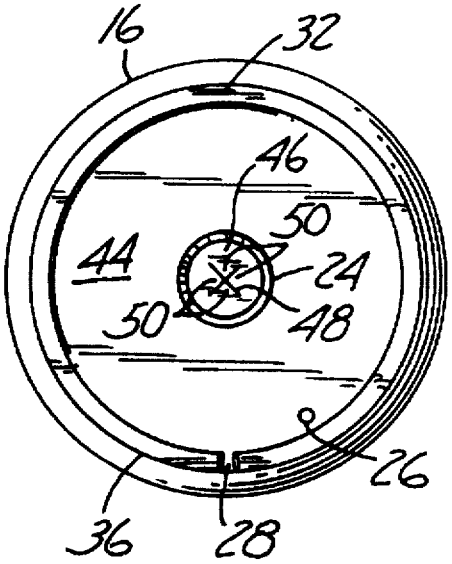

58
12
62
60

10
23
52
54
77
16
18
80
40
34
20
42
89
38
86
36

F
G
I
23
K
52
54
78
J
H
77
B
16
A
80
79
E
40
82A
D
C
89
82
38
82B
20
86
L
93
42
108
88
114
110
100
112
116
46
18
62
38
34
66
96
106
48
12
122
M
26
98
118
124
60
104
74
32
36
120
70
72
24
76
58

DISPENSING CONTAINER WITH DRAINAGE PASSAGES

REFERENCE TO CO-PENDING APPLICATION

Reference is hereby made to the following commonly assigned, co-pending application entitled DISPENSING CONTAINER WITH TRAVEL CAP (Ser. No. 08/476,858), filed on even date.

BACKGROUND OF THE INVENTION

This invention relates to a container and, more particularly, to a dispensing container for selectively dispensing flowable material for use.

Dispensing containers are known for holding flowable materials for discharge, such as bath products, shampoos and soaps. Such containers typically have a base for supporting the container and an opening for discharging flowable material from an inner cavity of the container. A cap usually secures the container during periods of non-use.

Typically, these containers are used in the shower or bathrooms. They must be supported on slippery wet surfaces. Also, if the containers are constructed so that water may seep into and collect in crevices or cavities of the container,, mildew and other bacteria may be allowed to grow and contaminate the container thus affecting the hygiene of the product.

SUMMARY OF THE INVENTION

The present invention relates to a dispensing container having an inner cavity for storing content to be dispensed and an opening for dispensing content. The container is supported by a base. The base includes a bottom face and a rim ridge about the periphery of the bottom face to define an elevated support ridge and a recessed end surface. A drain slot extends through the rim ridge for fluidly connecting the recessed end surface of the base to an outer surface of the container for allowing fluid trapped under the rim ridge of the container to drain so that mildew and other bacteria is not allowed to grow.

The base of the container may be formed of a base cap which is coupled to a bottle to form the container. The bottle is formed of a cylindrical main container segment, a cylindrical neck having a diameter smaller than the diameter of the main container segment, and a shoulder portion connecting the main container segment and the neck. The neck of the bottle includes a mouth. The base cap includes a through opening through the face and a cylindrical wall extending from the face to define an interior cavity. The base cap is sized so that the bottle fits into the interior cavity of the base cap. The wall of the base cap extends so that an exposed end of the wall abuts the bottle to form a base or housing cavity between the bottle and the base cap. The through opening of the base cap is aligned with the mouth of the bottle to define the dispensing opening for the container. The container includes a passage for draining fluid which has seeped into the base or housing cavity.

BRIEF DESCRIPTION OF THE DRAWINGS

FIG. 1 is perspective view of the dispensing container of the present invention shown with a travel cap supported at a closed end of the container.

FIG. 2 is a plan view of a dispensing end of the container of FIG. 1 illustrating a dispensing valve.

DETAILED DESCRIPTION OF THE PREFERRED EMBODIMENTS

Figure 1A:
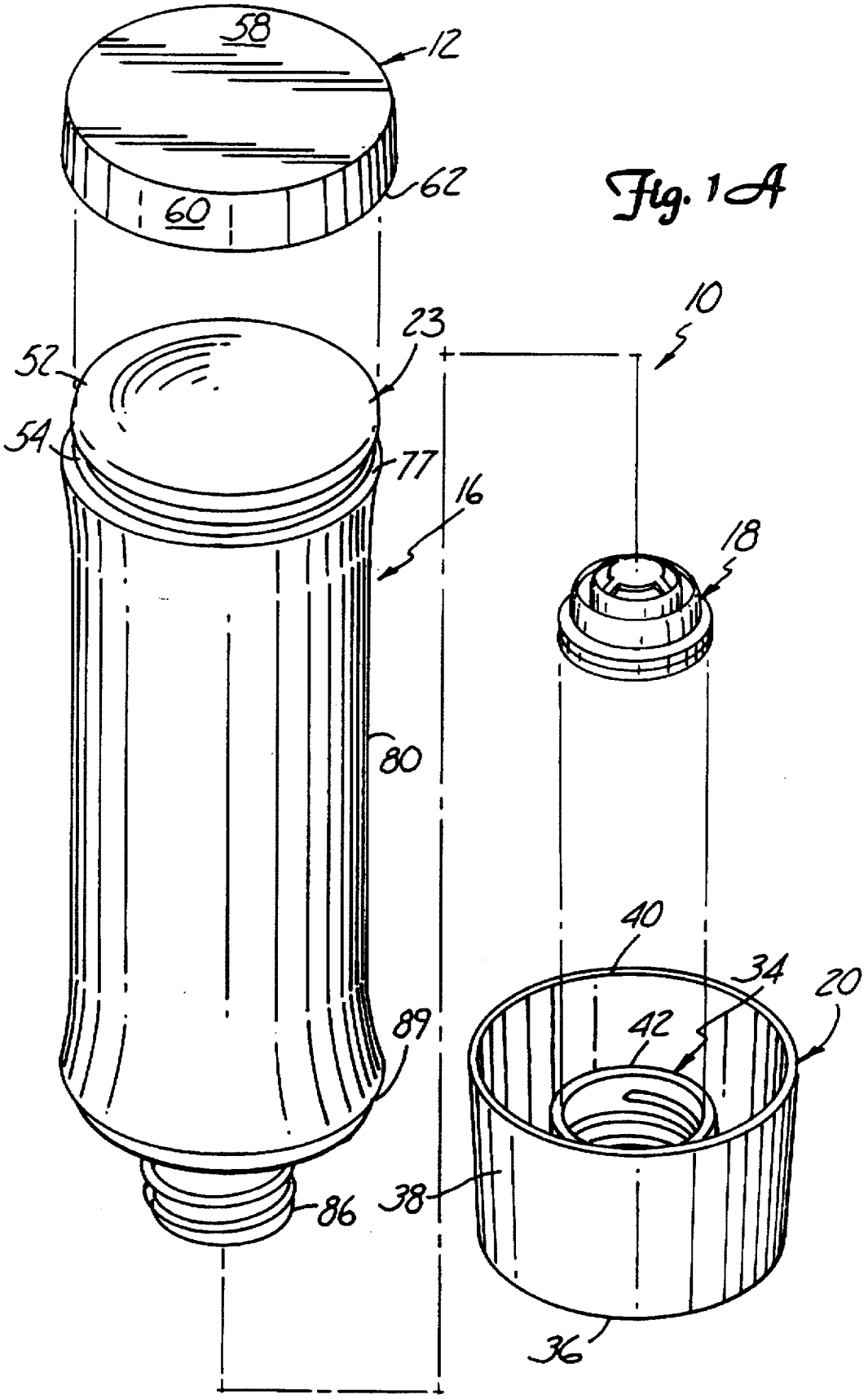
FIG. 1A is an exploded view of the dispensing container as shown in FIG. 1.
Figure 3:
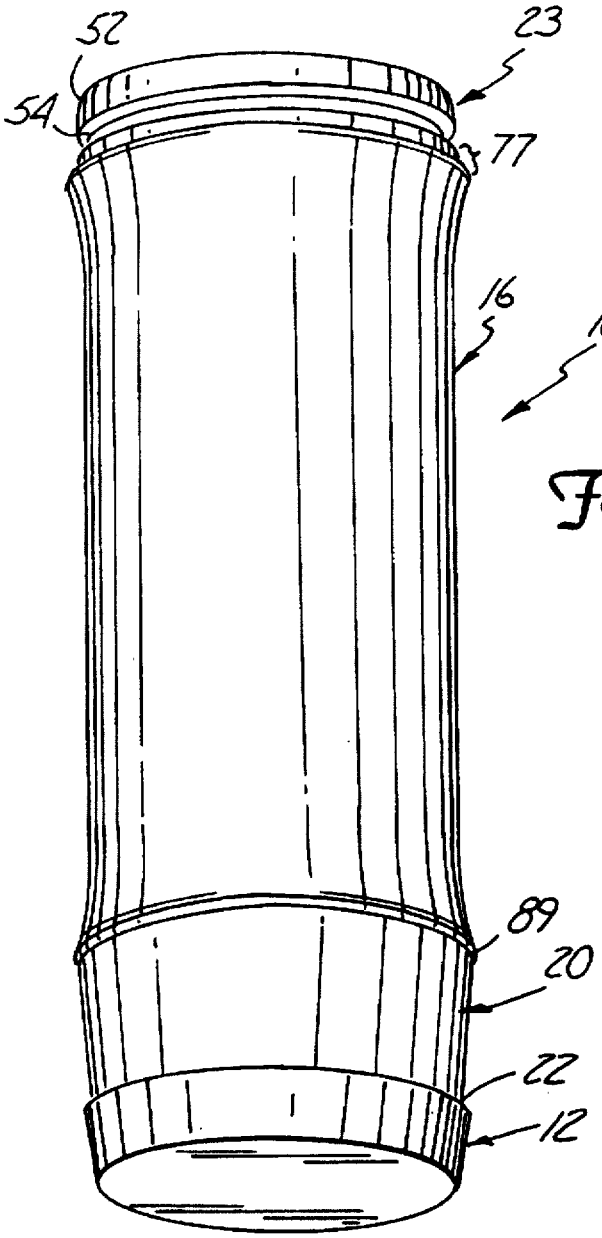
FIG. 3 is a perspective view of the dispensing container similar to FIG. 1 with the travel cap shown sealing the dispensing valve for transport.

FIGS. 1–3 disclose a dispensing container 10 of the present invention. As shown, more clearly in FIG. 1A, dispensing container 10 includes a travel cap 12, a bottle 16, a dispensing valve 18, and base cap 20. The dispensing valve 18 selectively dispenses flowable content such as soap, shampoo and other health and beauty products from the bottle 16 of the container 10 when the bottle 16 is squeezed. The valve 18 restricts the flow of content from the bottle 16 when the bottle 16 is not being squeezed.

As shown in FIG. 1, the, base cap 20 and dispensing valve 18 are both at a dispensing end 22 of the, container 10 so that the base cap 20 supports the container 10 in an upright inverted position as shown in FIG. 1 to define the base of the container. In the upright position, gravity forces the contents in the dispensing container 10 toward the dispensing valve 18 for immediate discharge when pressure is applied to the container 10. Thus, there is no need, while showering for example, to shake the bottle or wait for contents to slowly flow towards the bottle opening under the force of gravity. This feature is particularly useful as the container is emptied, since it would take longer and longer for content to be dispensed if the container were supported at the opposite end of a dispensing opening.

As shown comparatively in FIGS. 1 & 3, travel cap 12 is selectively positioned at a closed end 23 of the bottle 16 of the container 10 (FIG. 1) and at the dispensing end 22 (FIG. 3). The travel cap 12 is positioned at the closed end 23 as shown in FIG. 1 when content is to be dispensed through the dispensing valve 18 and at the dispensing end 22 to seal the dispensing valve 18 for transport as shown in FIG. 3.

As shown in FIGS. 1 and 1A, the base cap 20 is frustoconical shaped and includes a through opening 24, a drain hole 26, a drain slot 28, a rim ridge 32 and a threaded receptacle 34 (shown in FIG. 1A). As shown in FIG. 1A, the base cap 20 is formed of a cup-like member having a circular face 36, a sloped cylindrical side wall 38 and a rim 40 defining a housing structure. The side wall 38 extends from the circular face 36 and is sloped outwardly so that the diameter of the rim 40 is larger than the diameter of the circular face 36. The threaded receptacle 34 includes a threaded cylindrical wall 42 which extends essentially perpendicularly from face 36.

As shown in FIGS. 1 and 2, rim ridge 32 of base cap 20 circumferentially extends about an outer periphery of the face 36 to define an elevated support ridge and a recessed end surface 44. The drain slot 28 extends through the rim ridge 32 between the recessed end surface 44 and an outer surface of the container 10 to fluidly connect the end surface 44 to the outer surface of the container 10. The drain slot 28 allows for drainage of fluid trapped under the rim ridge 32 when the dispensing container 10 is supported by the base cap 20, so that mildew and other bacteria is not allowed to grow and collect between the recessed end surface 44 and the rim ridge 32.

As shown in FIG. 2, the dispensing valve 18 is formed of a silicone membrane 46 including a cross-shaped slit 48. The cross shaped slit 48 is cut through the silicone membrane 46 to define a plurality of relatively small flaps 50. The flaps 50 are aligned parallel to the silicone membrane 46 to define a closed position for the dispensing valve 18. To release flowable content, the flaps 50 open such that the flaps 50 are angled relative to the silicone membrane 46 to define an open position for the dispensing valve 18.

Figure 4:
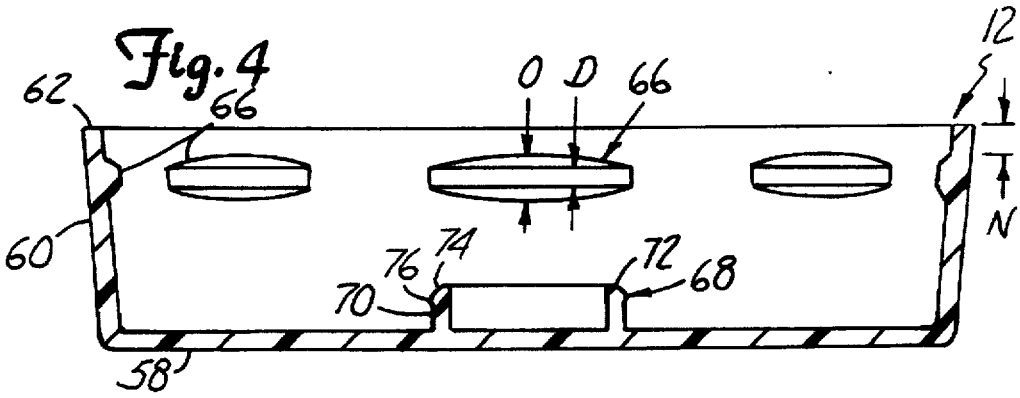
FIG. 4 is a cross-sectional view of the travel cap.

As shown in FIGS. 1A & 3, the closed end 23 of the container 10 includes a lip 52 and a circumferential groove 54. FIG. 4 is a cross sectional view of the travel cap 12. The travel cap 12 is formed of a cup-shaped member having a circular face 58, a cylindrical wall 60, and a rim 62. The cylindrical wall 60 extends from the periphery of the face 58. The wall 60 is sloped from the face 58 toward rim 62, to define a larger diameter for the rim 62 than the face 58. The rim 62 and wall 60 are sized to allow the closed end 23 of the container 10 to be inserted into the interior of the travel cap 12.

The travel cap 12 includes a plurality of lugs 66 (which extend about an inner surface of the cylindrical wall 60) and a plug 68. The plug 68 includes a circular ring 70 and a lip 72. The circular ring 70 extends essentially perpendicularly from the face 58 of the travel cap 12. Lip 72 extend about the periphery of the ring 70 and includes a sloped insertion face 74 and a sloped release face 76.

Figure 5:
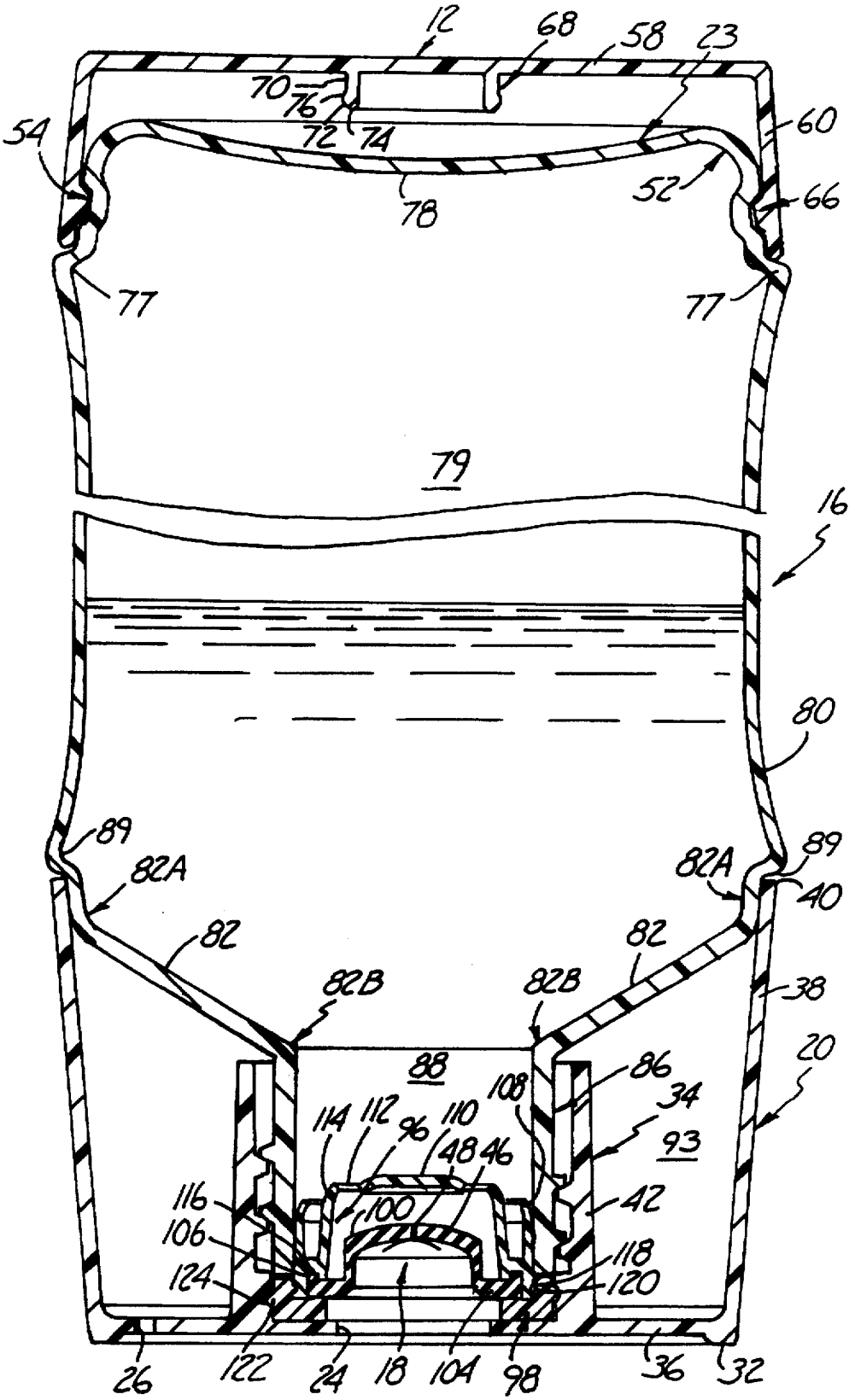
FIG. 5 is a cross-sectional view of the dispensing container, similar to FIG. 1, with the travel cap being supported at the closed end.
Figure 6:
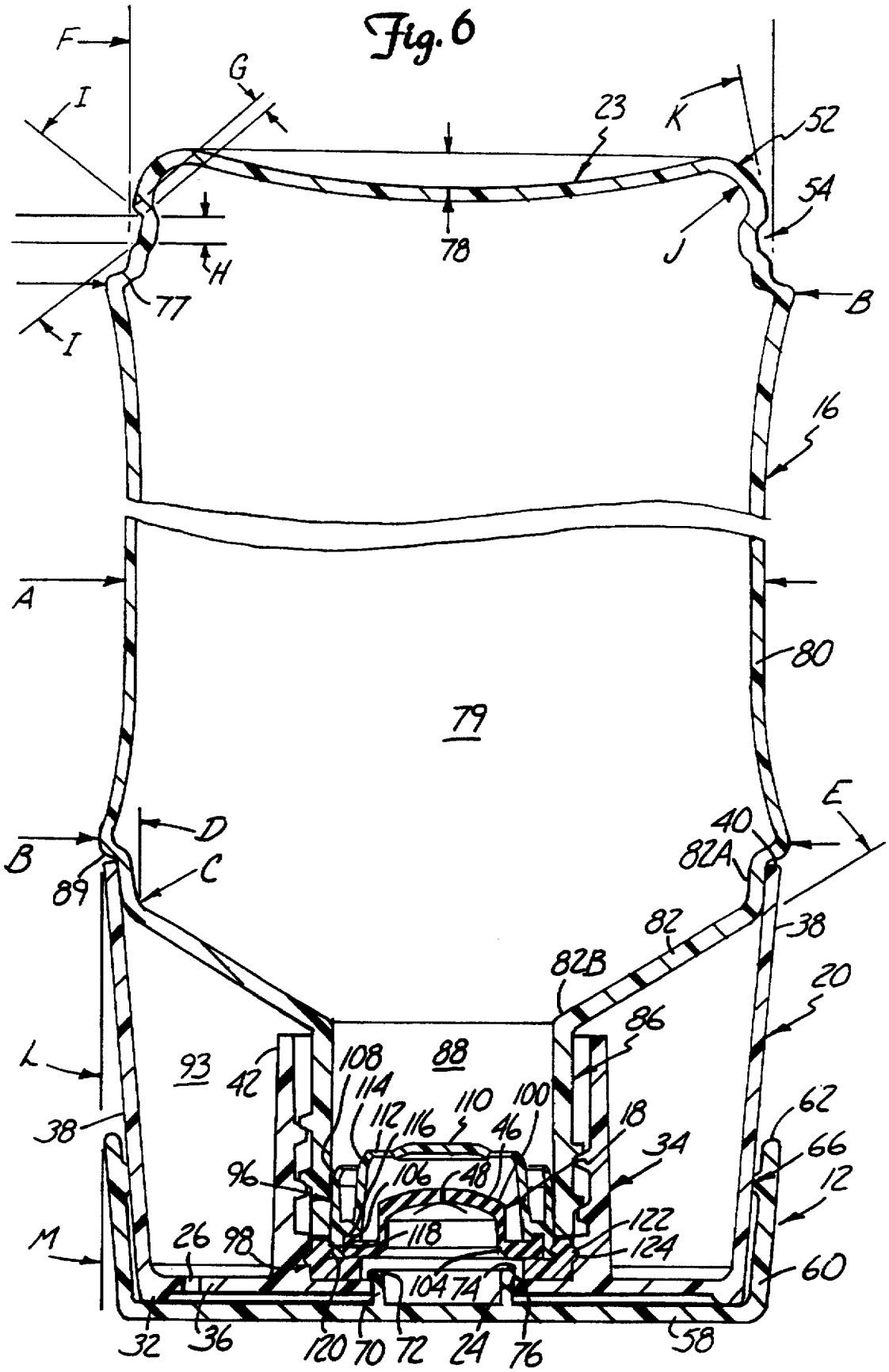
FIG. 6 is a cross-sectional view of the dispensing container, similar to FIG. 3, with the travel cap shown sealing the dispensing valve for transport.

FIGS. 5 and 6 are cross-sectional views of the container 10 of FIGS. 1 and 3, respectively. FIG. 5 illustrates the dispensing container 10 with the travel cap 12 supported at the closed upper end 23. FIG. 6 is a cross-sectional view of the dispensing container 10 with the travel cap 12 sealing the dispensing valve 18 at the dispensing end 22. The travel cap 12 is secured to the closed end 23 as shown in FIG. 5 by cooperation of the lugs 66 of the travel cap 12 and the circumferential groove 54 extending about the periphery of the closed end 23. Lip 52 is a curvedly shaped end about the periphery of the closed end 23. Lip 52 flexes the cylindrical wall 60 of the travel cap 12 as the travel cap 12 is forced onto the closed end 23 of the dispensing container 10 to snap fit the lugs 66 into groove 54 of the dispensing container 10.

A recessed ledge 77 between the bottle 16 and the closed end 23 of the dispensing container 10 accommodates the rim 62 of the travel cap 12. The recessed ledge 77 is dimensioned similar to the thickness of the wall 60 of the travel cap 12 to accommodate the travel cap 12.

To release the travel cap 12 from the closed upper end 23, the user pulls and gently twists the travel cap 12 from the closed end 23 to force the travel cap 12 about the curvedly shaped lip 52 to release the lugs 66 of the travel cap 12 from groove 54 of the closed end 23. As shown in FIG. 5, the lugs 66 of travel cap 12 are positioned a sufficient distance from the face 58 of the travel cap 12 to allow for clearance between an end face of the closed end 23 and the plug 68 of the travel cap 12. As shown, the end face of the closed end 23 is concave-shaped having a center dip 78.

As shown in FIGS. 5 and 6, the bottle 16 of the dispensing container 10 includes an inner cavity 79, a main container segment 80, shoulder 82, having an upper and lower portion 82A and 82B, a threaded neck 86 and mouth 88. Flowable content is filled into the inner cavity 79 of the main container segment 80 of the bottle 16 through mouth 88. The main container segment 80 is generally cylindrically and slightly concave-shaped. The neck 86 has a smaller diameter than the main container segment 80 and is connected to the main container segment 80 by the shoulder 82. Upper shoulder portion 82A is adjacent to the main container segment 80 and the lower shoulder portion 82B is adjacent to the neck 86. A recessed ledge 89 connects the main container segment 80 to the upper shoulder portion 82A.

The base cap 20 is screwed to the bottle 16 to form the dispensing container 10 via cooperation of the threaded receptacle 34 of the base cap 20 and the threaded neck 86 of the bottle 16. The depth of the base cap 20 is sufficient so that when the neck 86 of the bottle 16 is inserted into receptacle 34 of the base cap 20, the housing (face 36 and cylindrical wall 38) of the base cap 20 encloses the neck 86 and shoulder 82 of the bottle 16 to provide a cover structure for the threaded neck 86 and shoulder 82 of the bottle 16.

The through opening 24 of the base cap 20 is smaller than the mouth 88 of the bottle 16 and aligned therewith when the base cap 20 is screwed to bottle 16 to define the dispensing opening. Fluid is dispensed from the inner cavity 79 of the bottle 16 through the dispensing opening (mouth 88 of the bottle 16 and through opening 24 of the base cap 20). The dispensing valve 18 is seated in the mouth 88 of the bottle 16 to regulate flow of content, such as shampoos and soaps from the inner cavity 79 through the dispensing opening.

The rim 40 of the base cap 20 abuts against the upper shoulder portion 82A and recessed ledge 89 of the bottle 16. The recessed ledge 89 is sized relative to the width of the cylindrical side wall 38 of the base cap 20 to provide a smooth transition of the housing of the base cap 20 and the main container segment 80 of the bottle 16.

The enclosure of the base cap 20 about the neck 86 and the shoulder 82 of the bottle 16 defines; a base cavity or housing cavity 93. When the container 10 is used to dispense shampoos, soaps and other bath products, and the container 10 is used in the shower, water may seep through the abutment of the rim 40 of the base cap 20 and the bottle 16 at the upper shoulder portion 82A into the base cavity 93. Drain hole 26 extends through face 36 of the base cap 20 to allow fluid trapped in the base cavity 93 to drain so that mildew and bacteria do not grow.

FIG. 6 illustrates the travel cap 12 attached to the base cap 20 to seal the container 10 for transport. The interior of the travel cap 12 is sized to fit over a lower portion of the base cap 20 and the lugs 66 of travel cap 12 frictionally grip the outer surface of the wall 38 of the base cap 20. The ring 70 of the plug 68 is formed of a flexible material and is sized for insertion into through opening 24 of the base cap 20 to seal the opening 24. The lip 72 overhangs from the ring 70 so that the diameter of the lip 72 is slightly larger than the through opening 24. The height of the ring 70 between the face 58 of the cap 20 and lip 72 is sized so that the ring 70 extends through opening 24 and the lip 72 engages an inner surface of the face 36 of the base cap 20 to snap fit the travel cap 12 to the base cap 20 of the container 10.

The sloped insertion face 74 (best shown in FIG. 4) of lip 72 allows for insertion of the circular ring 70 and lip 72 through the through opening 24. To insert, the user pushes the travel cap 12 over the base cap 20 so that the circular ring 70 and lip 72 pass through opening 24 of the base cap 20. The sloped insertion face 74 contacts the base cap 20 at the through opening 24 to slightly flex the ring 70 for insertion of the ring 70 and lip 72 through the through opening 24. The sloped release face 76 (best shown in FIG. 4) is slightly sloped to facilitate removal of the travel cap 12. The sloped release face 76 flexes the ring 70 as the cap 12 is pulled from the base cap 20 so that the ring 70 and lip 72 may be slid through the through opening 24 for removal of the cap 12.

Figure 7:
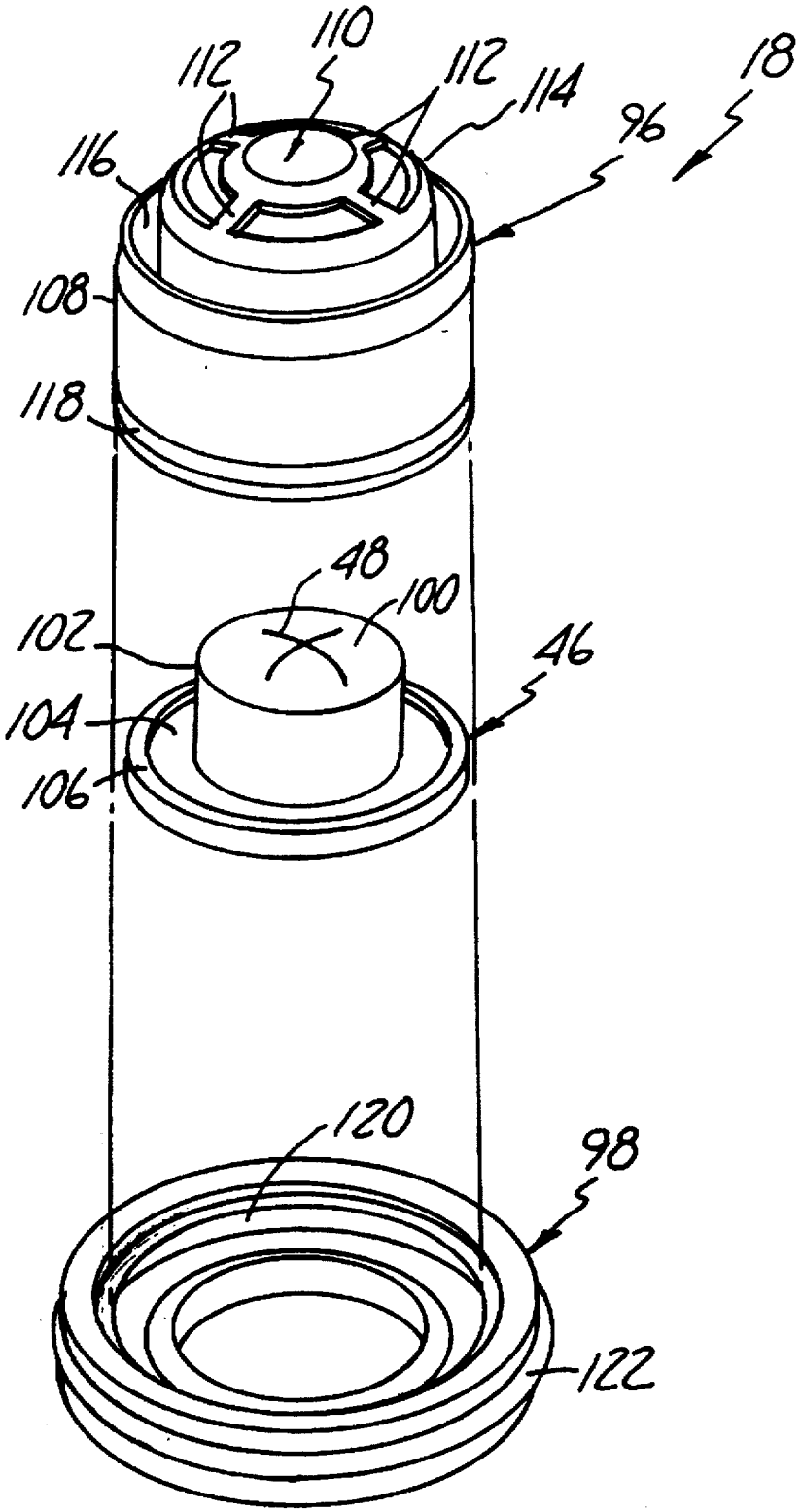
FIG. 7 is an exploded detailed view of the dispensing valve.

Dispensing valve 18, as shown in relation to FIGS. 5–7, includes the silicone membrane 46, and a first ring support 96 and a second ring support 98. The silicone membrane 46 is supported between the first ring support 96 and the second ring support 98. As shown in FIG. 7, the silicone membrane 46 is preformed into a cup-like member having a base 100, cylindrical wall 102, a support ledge 104, and flange 106. The cylindrical wall 102 extends from the base 100. The support ledge 104 extends perpendicularly from an open end of the cylindrical wall 102 (opposite the base 100) about the periphery thereof. Flange 106 extends essentially perpendicularly from ledge 104. The cross slit 48 is stamped at the base 100 of the cup-like member.

The first ring support 96 includes a flexible fit ring 108, a flow gate 110, flow gate support legs 112, a flow gate support ring 114, recess 116 (shown in FIGS. 5 & 6) and ring groove 118. The second ring support 98 includes ring ridge 120 and tongue 122. As best shown in FIGS. 5–6, recess 116 of the first ring support 96 is sized to accommodate and is aligned with flange 106 of the silicone membrane 46. Ring ridge 120 of the second ring support 98 snap fits into ring groove 118 of the first ring support 96 to connect the first and second ring supports 96 and 98 to support the ledge 104 of the silicone membrane 46 therebetween.

The fit ring 108 of the first ring support 96 is dimensioned similar to the mouth 88 of the bottle 16. When assembled, the first ring support 96 is inserted into the mouth 88 so that the fit ring 108 fictionally engages the neck 86 of the bottle 16 to secure the dispensing valve 18 relative to the mouth 88 of bottle 16.

The second ring support 98 is dimensioned similar to an outer surface of the neck 86 of the bottle 1.6. When assembled, the second ring support 98 is seated at an opened end of the neck 86 of the bottle 16. As shown in FIGS. 5 & 6, when the base cap 20 is screwed to the neck 86 of the bottle 16, a portion of the face 36 and a portion of the cylindrical wall 72 of the receptacle 34 of the base cap 20 abut against the second ring support 98 to the lock the dispensing valve 18 within the mouth 88 of the bottle 16. The second ring support 98 includes a circular tongue 122 which is sized to insert into a corresponding circumferential groove 124 formed about the cylindrical wall 42 of the receptacle 34 of the base cap 20.

The flow gate 110 is a circular plate dimensioned smaller than the diameter of the base 100 of the silicone membrane 46. The flow gate 110 is supported adjacent to the silicone membrane 46 in the mouth 88 of the bottle 16 to control the flow force of content directly toward the slit 48 to prevent unwanted seepage through the slit 48 of the silicone membrane 46. The flow gate 110 is supported by the first ring support 96 by the flow gate support ring 114. Legs 112 connect the flow gate 110 to the flow gate support ring 114. The legs 112 are spaced to allow fluid to flow past the flow gate 110 to be dispensed through the dispensing opening.

When the container 10 is supported by the base cap 20, fluid flows towards the silicone membrane 46. When pressure is applied to the container 10, the cup-like silicone membrane 46 inverts (not shown) and is forced outward and the flaps 50 of the valve 18 open (not shown) to release content from the inner cavity 79. When pressure is released the cup-like silicone membrane 46 reinverts as shown and the flaps 50 close to restrict the flow of content.

The cap 12, bottle 16 and base cap 20 are preferably formed of a high density polyethylene material. The silicone membrane 46 and slit 48 are dimensioned to restrict flow oil content from the inner cavity 79 of the container 10 until the container 10 is squeezed to dispense content.

As shown in FIG. 6, a dispensing container 10, having a longitudinal axis along an extent of the container and a diametric axis perpendicular to the longitudinal axis, may be constructed according to the present invention as follows. The bottle 16 of the container includes a main container segment 80 having a center portion having a diameter A of approximately 2.1 inches and opposed end portions having a diameter B of approximately 2.25 inches to define the concaved shape therefor. The neck 86 of the bottle 16 has an outer diameter of approximately 0.85 inches and the mouth 88 of the bottle 16 has a diameter of approximately 0.72 inches.

The upper shoulder portion 82A, adjacent the recessed ledge 89 includes a rounded edge having a radius C of approximately 0.1 inches and is slightly sloped at an angle D of approximately 5 degrees relative to the longitudinal axis toward the lower shoulder portion 82B. The diameter of the upper shoulder portion 82A at the recessed ledge 89 is approximately 2.1 inches. The shoulder 82 is sloped between the upper shoulder portion 82A and the lower shoulder portion 82B at an angle E of about a 30 degree angle relative to the diametric axis of the bottle 16 to connect the main container segment 80 and the neck 86 of the bottle 16.

The diameter F of the closed end 23 is approximately 2.1 inches. The sides of the groove 54 of the closed end 23 have a thickness G of approximately 0.04 inches and the width H of a base of the groove 54 is approximately 0.05 inches. The sides of the groove 54 are formed at an angle I of about 45 degrees, relative to the diametric axis of the bottle 16. The lip 52 of the closed end 23 includes a rounded end having a radius J of approximately 0.15 inches and a side edge which is sloped inwardly from the groove 54 at an angle K of approximately 5 degrees relative to the longitudinal axis of the bottle 16. The center dip 78 of the closed end 23 has approximately a 0.1 inch depth. The overall height of the bottle 16 is approximately 6.2 inches. The height of the main container segment 80 is approximately 4.62 inches, shoulder 82 is approximately 0.55 inches, neck 86 is approximately 0.65 inches, closed end 23 is 0.40 inches and lip 52 is approximately 0.19 inches. The height of shoulder portion 82A is approximately 0.19 inches.

The diameter of the through opening 24 of the base cap 20 is approximately 0.47 inches and the diameter of the rim 40 of the base cap 20 is 2.2 inches. The thickness of cylindrical sidewall 38 is approximately 0.045 inches. The height of the base cap 20 is 1.375 inches and the height of the wall 42 of the receptacle 34 is approximately 0.8 inches. The height of the base cap 20 and the extent of the wall 42 of the receptacle 34 accommodate for the valve 18 and allow the rim 40 of the base cap 20 to seat at the recessed ledge 89 of the bottle 16. The wall 38 of the base cap 20 is sloped outwardly from the face 36 toward rim 40 at an angle L of about 5 degrees relative to the longitudinal axis. The height of the rim ridge 32 at the periphery of the face 36 of the base cap 20 is approximately 0.025 inches. Preferably, the drain hole is approximately 0.080 inches in diameter. The width of the drain slot 28 is approximately 0.1 inches.

The diameter of the travel cap 12 at the rim 62 is approximately 2.2 inches. The height of the travel cap 12 is approximately 0.575 inches. The wall 60 of the travel cap 12 is sloped outwardly from the face 58 to the rim 62 at an angle M of 5 degrees relative to the longitudinal axis. The height of the ring 70 and lip 72 of plug 68 is approximately 0.125 inches. As shown in FIG. 4, the lugs 66 are positioned a distance N of approximately 0.0625 inches below the rim 62 of travel cap 12. The thickness O of the lugs 66 is approximately 0.11 inches and thickness P of the lugs 66 is approximately 0.05 inches.

Conclusion

Thus, there has been described a dispensing container 10 which is designed for use in a shower or bathroom. The container 10 is designed to be supported on slippery wet surfaces and is also designed to allow fluid which has seeped into crevices or cavities of the container to drain so that mildew and other bacteria is not allowed to grow. As described, the container 10 includes rim ridge 32 about the periphery of the face 36 of the base of the container 10. The rim ridge 32 defines an elevated support ridge and a recessed end surface 44 for supporting the container 10 on wet surfaces. The drain slot 28 through the rim ridge 32 fluidly connecting the recessed end surface 44 to the outer surface of the container 10 and the drain hole 26 through the face 36 fluidly connecting the base cavity 93 to the outer surface of the container 10 allow fluid to drain from cavities of the container 10 so that mold and mildew is not allowed to grow.

Although the present invention has been described with reference to preferred embodiments, workers skilled in the art will recognize that changes may be made in form and detail without departing from the spirit and scope of the invention.

What is claimed is:

1. A dispensing container comprising:

a bottle having an inner cavity for storing material, the bottle having a main container segment having a closed end and a neck, the neck having a mouth opened to the inner cavity to connect the inner cavity to ambient and defining an opened end of the container, the cross sectional area of the neck being smaller than the cross sectional area of the main container segment and the bottle having a shoulder portion connecting the main container segment and the neck;

a base for supporting the container in an upright position, said base comprising a support face, side wall and a through opening, the support face being dimensioned larger than the neck of the bottle, said side wall extending from said face to define a base cavity therein, said base cavity being sized to house the opened end of the bottle, said through opening extending through the face and being coupled with the mouth to collectively define a dispensing opening for discharging material from the inner cavity of the container, said container being supported at its base with the through opening normally opened to ambient;

means for attaching the base relative to the bottle for supporting the container in an upright position relative to the support face of the base;

a valve operably coupled with the dispensing opening for regulating discharge of material from the inner cavity of the container; and a drain hole extending through the face of the base to ambient for fluidly connecting the base cavity to ambient, the drain hole being normally opened to ambient when the container is supported at its base for draining fluid from the base cavity.

2. The dispensing container of claim 1 and further comprising:

a rim ridge extending about an outer perimeter of the face of the base to define an elevated support surface and a recessed end surface; and a drain slot through the rim ridge for fluidly connecting the recessed end surface of the base to an outer surface of the container for allowing fluid trapped under the rim ridge of the container to drain.

3. The dispensing container of claim 1 wherein the drain hole is circular shaped.

4. The dispensing container of claim 1 wherein the neck of the bottle is threaded and the means for attaching the base relative to the bottle includes a threaded receptacle extending from the face of the base within the base cavity, said threaded receptacle being designed to align with the threaded neck of the bottle for detachably connecting the base relative to the bottle.

5. The dispensing container of claim 1 wherein the side walls of the base is sloped outwardly from the support face to define a frusto conical shaped base.

6. The dispensing container of claim 1 wherein the valve comprises:

a silicone membrane having a slit therethrough; and a valve support assembly comprising:

a first ring support;

a second ring support; and means for connecting said first and second ring supports to support the silicone membrane therebetween.

7. The dispensing container of claim 6 wherein the means for connecting the first and second ring supports comprises a ridge and groove connection, one of said first or second ring supports including a circumferential ridge and the other of said first or second ring supports including a circumferential groove, said ridge of said first or second ring support being aligned with the groove of the other of said first or second ring support for insertion therein for detachably connecting said first and second ring supports.

8. The dispensing container of claim 6 wherein said valve support assembly is separately formed and configured for insertion into the mouth of the bottle and further including means for selectively securing the valve support assembly relative to the mouth of the bottle for operation of the valve of the container.

9. The dispensing container of claim 6 wherein the first ring support includes a flexible fit ring, said flexible fit ring being sized relative to the mouth of the bottle for frictionally securing the valve support assembly relative to the mouth of the bottle for operation of the valve of the container.

10. The dispensing container of claim 6 wherein the second ring support is sized larger than the mouth of the bottle and is designed to seat against the neck of the bottle.

11. The dispensing container of claim 6 wherein the second ring support of the valve support assembly includes a tongue sized to selectively snap fit into a corresponding groove on the base of the container to secure the valve relative to the mouth of the container.

12. The dispensing container of claim 6 wherein the through opening of the base is sized smaller than the mouth of the bottle to provide a lip portion for securing the valve within the mouth of the bottle.

13. The dispensing container of claim 6 and further including a flow gate operatably coupled with the valve for controlling the flow of fluid toward the valve.

14. The dispensing container of claim 13 wherein the flow gate comprises:

a circular plate sized smaller than the mouth of the bottle; and means for supporting said circular plate relative to the valve for regulating the flow of fluid toward the valve.

15. The dispensing container of claim 14 wherein the means for supporting the circular plate of the flow gate comprises:

a flow gate support ring coupled with the first support ring; and a plurality of legs having opposed ends, one end of said legs being coupled with the flow gate support ring and the other end of said legs being coupled with said circular plate, the legs being spaced to define flow passages therebetween for dispensing material from the inner cavity of the container through the valve.

16. In a dispensing container having an inner cavity for storing material, means for dispensing material from the inner cavity and a base for supporting the container, the base having an essentially planar face for supporting the dispensing container in an upright position and side wall extending from said face to define a base cavity therein, wherein the improvement comprises:

a through opening extending through the face of the base and operably connected to the inner cavity of the container for dispensing material from the inner cavity of the container, said container being supported at its base with the through opening normally opened to ambient;

a valve for regulating the flow fluid from the inner cavity of the container through the through opening of the base while the container is supported at the base; and a drain hole extending through the face of the base and coupled to the base cavity, the drain hole being normally opened to ambient when the container is supported at its base for draining fluid from the base cavity.

17. In a dispensing container having an inner cavity for storing material and a dispensing means for dispensing material from the inner cavity of the container, said container being supported by a base having a support face and side wall extending from the face to define a base cavity therein, said support face of the base supporting the container in an upright position, the improvement comprising:

said face of said base including a through opening coupled with the inner cavity for dispensing material from the inner cavity; and a drain hole operably coupled to the base cavity for draining fluid from the base cavity, the drain hole and through opening being axially aligned relative to a longitudinal extent of the container to discharge fluid axially from the base cavity to ambient and from the inner cavity of the container to ambient.

18. In a dispensing container having an inner cavity for storing material, a dispensing means for dispensing material from the inner cavity of the container, and a base for supporting the dispensing container, wherein the improvement comprises:

a generally U-shaped rim edge extending about an entire outer perimeter of a face of the base to define an elevated support surface and a recessed end surface;

a through opening in the recessed end surface coupled with the inner cavity to discharge fluid from the inner cavity; and a relatively thin drain slot extending through the rim ridge for connecting a recessed end cavity defined by the recessed end surface and the rim ridge to ambient outside the base.

19. A dispensing container comprising:

a bottle having an inner cavity for storing material, the bottle having a main container segment having a closed end and a neck, the neck having a mouth opened to the inner cavity to connect the inner cavity to ambient and defining an opened end of the container, the cross sectional area of the neck being smaller than the cross sectional area of the main container segment and the bottle having a shoulder portion connecting the main container segment and the neck;

a base for supporting the container in an upright position, said base comprising a support face, side wall and through opening, the support face being dimensioned larger than the neck of the bottle, said side wall extending from said face to define a base cavity therein, said base cavity being sized to house the opened end of the bottle, said through opening extending through the face and being coupled with the mouth to collectively define a dispensing opening for discharging material from the inner cavity of the container;

means for attaching the base relative to the bottle for supporting the container in an upright position relative to the support face of the base;

a valve operably coupled with the dispensing opening for regulating discharge of material from the inner cavity of the container;

a drain hole extending through the face of the base to ambient for fluidly connecting the base cavity to ambient, the drain hole being normally opened to ambient when the container is supported at its base for draining fluid from the base cavity;

a rim ridge extending about an entire outer perimeter of the face of the base to define an elevated support surface and a recessed end surface; and a relatively thin drain slot through the rim ridge for fluidly connecting the recessed end surface of the base to an outer surface of the container for allowing fluid trapped under the rim ridge of the container to drain.

* * * * *

UNITED STATES PATENT AND TRADEMARK OFFICE

CERTIFICATE OF CORRECTION

PATENT NO. : 5,626,262

DATED : MAY 6, 1997

INVENTOR(S) : TIMOTHY E. FITTEN, DIETER F. LAY, THOMAS M. BENDER

It is certified that error appears in the above-indentified patent and that said Letters Patent is hereby corrected as shown below:

Col. 1, line 25 after "container,,", delete "second coma"

Col. 2, line 27, after "the,", delete ","

Signed and Sealed this

Ninth Day of September, 1997

*Attest:*

*Attesting Officer*

BRUCE LEHMAN

*Commissioner of Patents and Trademarks*